US006663343B1

(12) United States Patent
Anderson

(10) Patent No.: US 6,663,343 B1
(45) Date of Patent: Dec. 16, 2003

(54) IMPELLER MOUNTING SYSTEM AND METHOD

(75) Inventor: J. Hilbert Anderson, York, PA (US)

(73) Assignee: Sea Solar Power, Inc., York, PA (US)

( * ) Notice: Subject to any disclaimer, the term of this patent is extended or adjusted under 35 U.S.C. 154(b) by 0 days.

(21) Appl. No.: 10/180,332

(22) Filed: Jun. 27, 2002

(51) Int. Cl.[7] ..... F04D 29/20
(52) U.S. Cl. ..... 415/216.1; 416/205
(58) Field of Search ..... 415/216.1, 98, 415/101, 102; 416/244 R, 204 R, 205, 198 R

(56) References Cited

U.S. PATENT DOCUMENTS

| | | | | |
|---|---|---|---|---|
| 1,873,956 A | | 8/1932 | Dahlstrand | |
| 2,438,866 A | | 3/1948 | Rockwell et al. | |
| 4,257,744 A | | 3/1981 | Watson | |
| 4,628,574 A | | 12/1986 | Lerman | |
| 4,915,589 A | | 4/1990 | Gessler et al. | |
| 5,022,823 A | * | 6/1991 | Edelmayer | 416/224 A |
| 5,775,878 A | | 7/1998 | Maumus et al. | |
| 5,797,727 A | | 8/1998 | Peters et al. | |
| 5,882,178 A | | 3/1999 | Hudson et al. | |
| 6,012,901 A | | 1/2000 | Battig et al. | |

* cited by examiner

*Primary Examiner*—Edward K. Look
*Assistant Examiner*—Dwayne J. White
(74) *Attorney, Agent, or Firm*—Venable LLP; John P. Shannon

(57) ABSTRACT

An article, such as an impeller, is mounted for torque transmission by a shaft by positioning the article in contact with a threaded collar engaging tapered threads on the shaft and applying an axial force to the article to move and tighten the threaded collar on the tapered threads. The axial force is applied to the article by a clamping collar which contacts the article only in an area spaced from a central bore of the article in order to deflect a portion of the article defining the central bore radially inward toward the shaft. In one embodiment, two impellers are positioned back-to-back, with one impeller receiving an axial force spaced radially from a central bore of the impeller by an annular formation on the other impeller.

28 Claims, 1 Drawing Sheet

IMPELLER MOUNTING SYSTEM AND METHOD

BACKGROUND OF THE INVENTION

1. Field of the Invention

This invention relates to a new and useful invention concerning a system and a method for mounting an article, such as an impeller and/or a gear mechanism, onto a drive shaft. In particular, this invention relates to a system and method for mounting one or more impellers on a drive shaft for use, for example, in a centrifugal compressor.

2. Description of the Prior Art

The usual method for mounting articles on drive shafts is to employ keys and keyways. Keyways are machined into the drive shaft and into the central bore of the article, and keys are provided to connect the article to the drive shaft with a view to providing a secure fit sufficient to transmit torque. When conventional keys and keyways are used to mount an article such as an impeller on a drive shaft to transmit torque, positive torque is transmitted but the shaft is weakened because of high stress raised by the keyway. The mounted article is also weakened by the keyway in the bore. It is therefore desirable not to employ keys and keyways to transmit torque to mounted articles, particularly impellers.

Accordingly, it is an object of the present invention to provide a system for mounting an article on a drive shaft without employing keys and keyways.

It is yet another object of the present invention to provide a method of mounting an article on a drive shaft without employing keys and keyways.

SUMMARY OF THE INVENTION

These and other objects are accomplished by the present invention in a system comprising tapered threads on an impeller shaft; a threaded collar having threads effective to engage the tapered threads on the impeller shaft; at least one impeller on the impeller shaft in contact with the threaded collar; a clamping collar adjacent to the impeller, on a side of the impeller opposite the threaded collar; and an arrangement applying a generally axial force against the clamping collar in a direction toward the threaded collar so that the threaded collar slides up on the tapered threads. In a preferred embodiment, the force applying arrangement comprises a clamping collar having an annular formation extending axially into contact with the impeller only in an area of the impeller spaced radially from its central bore, and a threaded arrangement with the impeller shaft for applying an axial force to the clamping collar. Because the axial force is applied only in an area spaced radially from the central bore of the impeller, the force deforms the impeller such that the central bore is slightly reduced at the side of the impeller opposite the force applying arrangement. As a result, the radial tolerances between the impeller shaft and that side of the impeller are reduced, thereby better centering the impeller on the shaft and decreasing any tendency of the impeller to vibrate, particularly at the high speeds of a centrifugal compressor, for example, 17,000 RPM. In some cases, the deformation results in radial clamping of the impeller on the impeller shaft, thereby enabling torque to be transmitted to the impeller through the area of clamping.

In one embodiment, first and second opposing impellers are positioned adjacent to one another, each having a central bore. The first impeller is positioned adjacent the clamping collar and comprises an annular formation extending axially into contact with the second impeller in an area of the second impeller spaced radially from the central bore of the second impeller so that the first impeller contacts the second impeller only along the annular rim. As a result, the second impeller exhibits a deformation, vibration reduction and, in some cases, radial clamping and torque transmission, as was just described in connection with the first impeller.

The threaded collar slides up and tightens on the tapered threads as the axial force is applied, whereby the threaded collar is held tightly on the impeller shaft, and torque is transmitted through the threaded connection from the impeller shaft to the threaded collar. Torque is transmitted from the threaded collar to the impeller through their mutually contacting surfaces. Where there are two impellers, torque is transmitted from the impeller adjacent the threaded collar to the other impeller through their mutually contacting surfaces.

The slight deflection of the clamping collar due to its shape, and the slight deflection of the impellers by having the contact areas spaced radially outward creates a spring effect so that even though the impellers may change in temperature with respect to the shaft, and try to expand, there is enough spring action and allowable deflection in the impellers and the collar that the assembly will remain tight under all operating conditions.

Other advantages are that:

1. The impellers are easy to machine and have no stress raisers with keys in the shaft. Therefore, this gives them additional strength.
2. The shaft itself is smooth and round and has no stress raisers in it, and therefore the minimum possible shaft diameter can be used.
3. The shaft diameter being small can allow a ball bearing supporting it to be slid over the shaft, and this permits the bearing supporting the impellers to be as close as possible to the impellers, which are unsupported on the side opposite to the ball bearing. This assures minimum vibration during high-speed operation, and assures that the natural frequency or critical speed is well above operating speed.
4. The shaft between the bearing just mentioned and a bearing distal to the impellers can be much larger and therefore stiffer so that minimum vibration is assured by being able to have the shaft within the impellers be as small as possible and being able to slide the closer bearing over the shaft itself. This makes for a strong assembly that provides maximum strength against vibration, and also permits the impellers to utilize their full strength without having any stress raisers such as keyways in the bore of the impeller. This invention permits high strength, high speed, mounting of the impellers so that the optimum operating conditions can be achieved.

BRIEF DESCRIPTION OF THE DRAWING

The sole drawing FIGURE is across-sectional view of a portion of a centrifulgal compressor showing a pair of opposing impellers mounted on a drive shaft by the impeller mounting system and method according to the invention.

DESCRIPTION OF THE PREFERRED EMBODIMENTS

Figure 1:
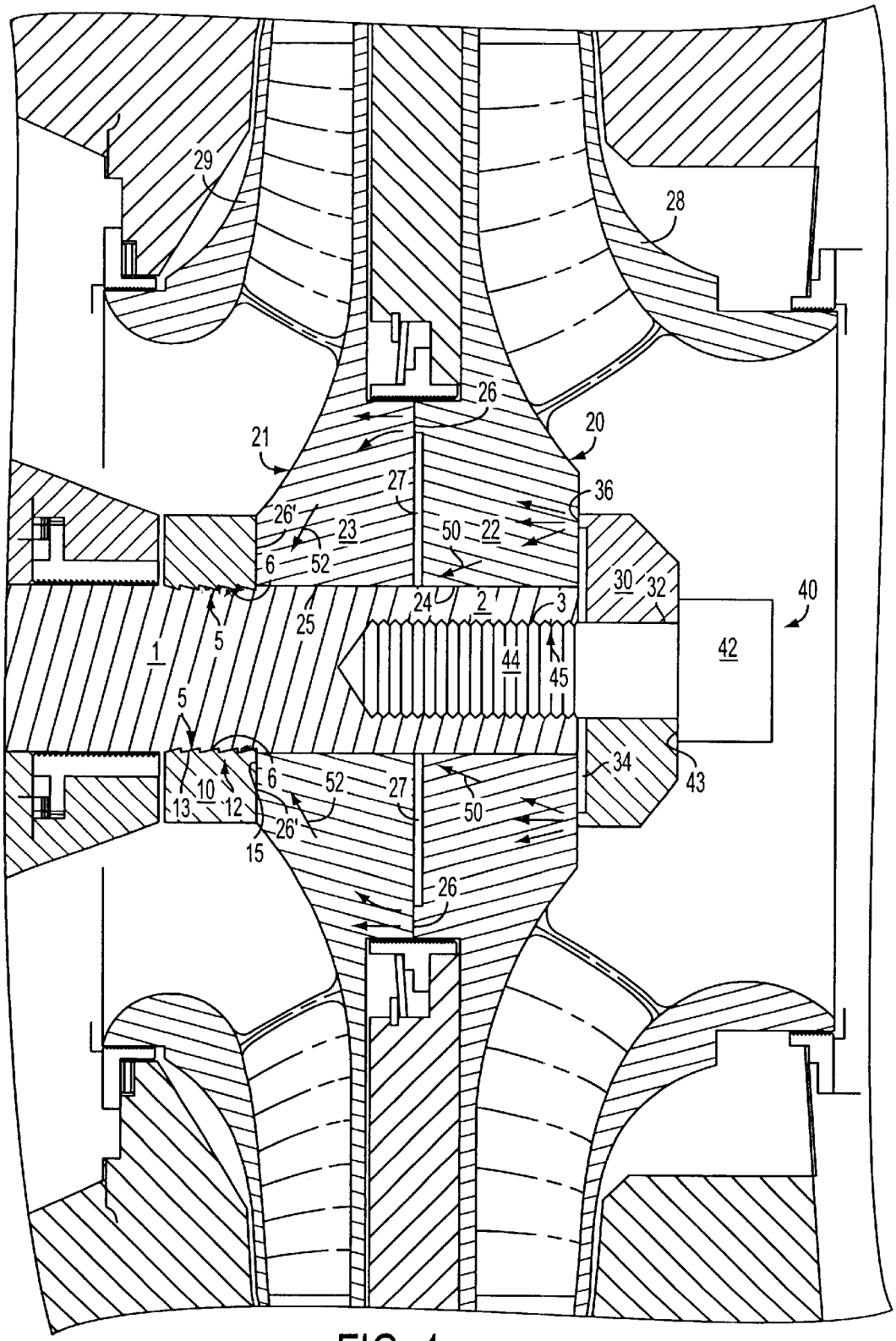

Referring to the drawing, drive shaft 1, shown as impeller shaft 1, has a round cross-section and is generally smooth.

Impellers 20,21 are shown mounted directly on impeller shaft 1 without any keys to transmit torque from the impeller shaft 1 to impellers 20,21. Impellers 20,21 have respective hubs 22,23 and respective outer regions 28,29. Hubs 22,23 have defined therein respective central bores 24,25 which are smooth and do not have keyways defined therein. Correspondingly, the exterior of impeller shaft 1 is smooth and does not have keyways defined therein. Thus, impellers 20,21 have smooth central bores 24,25 that slide onto the smooth outer surface of impeller shaft 1. These parts are not only easy to machine but have greater strength than similar parts having conventional key and keyway mounting systems.

Impeller shaft 1 has a threaded section 5 having tapered threads 6 for engaging a threaded collar 10. Threaded collar 10 has a central bore 12 provided with threads 13, shown as tapered threads 13, and slides onto the impeller shaft 1. Threaded collar 10 is screwed into position on the threaded section 5 of the impeller shaft 1.

After installation of threaded collar 10, impellers 20,21 are inserted onto impeller shaft 1. Impellers 20,21 are shown as being arranged in an opposing manner, but the respective arrangement of impellers may be varied to suit the application. Impellers 20,21 meet along an annular interface shown as annular rim 26 extending axially from the impeller 20 (first impeller 20) toward the impeller 21 (second impeller 21) with an annular gap 27 defined between impellers 20,21 radially inside the annular rim 26.

Impellers 20,21 are shown fastened to the impeller shaft 1 by a clamping collar 30 and fastening means 40, shown as a cap screw arrangement 40. Clamping collar 30 has a central bore 32 and an axially extending annular rim 36. Annular rim 36 has a diameter that is larger than the diameter of the shaft 1 but, in the illustrated embodiment, smaller than the diameter of annular rim 26. Cap screw 40 has a cap 42 and a threaded shaft 44 having defined therein threads 45 threadedly received in a threaded central bore 3 in an end 2 of the impeller shaft 1.

When tightened, cap screw 40 pushes the annular rim 36 of the clamping collar 30 axially against impeller 20, which in turn pushes against impeller 21 along interfacial annular rim 26, and the two impellers 20,21 are thus forced against a side face 15 of threaded collar 10. By applying the force of the cap screw 40 through the annular rim 36 to the hub 22 of impeller 20 and annular rim 26 of impeller 20 to the hub 23 of impeller 21 only along annular areas spaced radially outward from the bores 24,25 of the impellers, as indicated in the figure by the arrows 50,52 emanating respectively from the annular rims 36 and 26, the impellers 20,21 are slightly sprung, i.e., deflected, radially inward in portions of the bores 24,25 distal to the clamping collar 30. This deflection serves to more precisely center impellers 20,21 with respect to the axis of the impeller shaft I and to cause hubs 22, 23 to be tightly held against the annular outer surface 15 (side face 15) of threaded collar 10. In some cases, the deflection tightens the surfaces in portions of the respective bores 24,25 against the outer surface of impeller shaft 1, resulting in increased friction between the respective bores 24,25 and the impeller shaft.

This increased friction, when present, is in addition to a substantial radial force on the impeller shaft 1 created by the interaction of the threads 13 of threaded collar 10 on the threads 6 of the impeller shaft 1. The threads 6 of threaded section 5 and the threads 13 are both shown as tapered threads 6,13, and are inclined radially inward from an edge of the threads distal to the clamping collar 30 to an edge of the threads nearer the clamping collar 30. As a result, as threaded shaft 44 of cap screw 40 is tightened onto the threaded central bore 3 of end 2 of the impeller shaft 1 and pushes clamping collar 30 against impellers 20,21, which pushes impellers 20,21 against threaded collar 10, threaded collar 10 slides up slightly on its tapered threads 13, and the tapered collar 10 becomes tight on the impeller shaft 1. Then, the force of the clamping collar 30 holds the impellers 20,21 stationary against the threaded collar 10 along interfacial surface 26' and against one another. The tightened engagement of tapered threads 13 of threaded collar 10 on tapered threads 6 of the impeller shaft 1 creates a substantial amount of radial force on impeller shaft 1 so that the torque can be transmitted by friction through threaded collar 10 to the impellers 20,21.

The cap screw/clamping collar/impeller frictional force arrangement creates a spring effect so that, even though the impellers 20,21 may change in temperature with respect to the impeller shaft 1 and try to expand, there is enough spring action and allowable deflection in the impellers 20,21 and in the clamping collar 30 that the assembly will remain tight under all operating conditions.

The deflection of the impeller hub(s) to reduce the diameter of the bore so that the material surrounding the bore contacts the shaft and thereby produces a friction force to assist in torque transmission can happen when the tolerance between the shaft diameter and the bore diameter of the impeller is small. Even where this friction force is absent, deflecting the hub(s) by putting the clamping force at a relatively large diameter decreases the clearance between the bore of the hub and the shaft. This means that the impellers are centered more accurately than they would be if they were not deflected slightly. The threaded collar 10 does not prevent the clamping collar 30 from deflecting the respective bores 24,25 of the impellers 20,21 toward the impeller shaft 1 because the forces causing the deflection also move the threaded collar 10 axially along the tapered threads 13.

When the drive shaft is part of a centrifugal compressor driven by a motor coupled to an input shaft, the input shaft is typically connected to a gear system that causes the drive shaft, e.g., an impeller shaft, to run at higher speeds than the input shaft. Typically, the input shaft is connected to a motor running at 3500 RPM, and the impeller shaft rotates at speeds of approximately 17,000 RPM. Such a compressor might absorb as much as 1,200 HP at the input shaft. Therefore, the connection of the impeller shaft to the impellers must be quite strong to transmit this amount of power. The mounting system and method of this invention satisfies even such rigorous requirements.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A system for mounting at least one impeller on an impeller shaft without keys and keyways, comprising:

an impeller shaft having tapered threads;

a threaded collar positioned on the impeller shaft and defining a central bore having threads effective to engage the tapered threads on the impeller shaft;

at least one impeller positioned on the impeller shaft and in contact with the threaded collar, the tapered threads of the impeller shaft having a first surface generally facing the impeller and a second surface generally facing away from the impeller, said first surface defining a first angle with the longitudinal axis of the impeller shaft and defining a second angle with a plane normal to said longitudinal axis, wherein said first angle is less than said second angle; and an arrangement axially forcing the impeller into contact with the threaded collar and axially forcing the threaded collar into torque transmitting contact with the tapered threads of the impeller shaft.

2. The system according to claim 1, wherein the impeller has a central bore, and wherein the axial forcing arrangement comprises means for applying force to the impeller only in a region of the impeller spaced radially from the central bore, whereby the force deflects radially toward the impeller shaft a portion of the impeller defining the central bore.

3. The system according to claim 1, wherein the threads of the threaded collar are tapered threads.

4. A system for mounting at least one impeller on an impeller shaft without keys and keyways, comprising:

an impeller shaft having tapered threads;

a threaded collar positioned on the impeller shaft and defining a central bore having threads effective to engage the tapered threads on the impeller shaft;

at least one impeller positioned on the impeller shaft and in contact with the threaded collar; and an arrangement axially forcing the impeller into contact with the threaded collar and axially forcing the threaded collar into torque transmitting contact with the tapered threads of the impeller shaft, wherein the axial forcing arrangement comprises:

a clamping collar positioned on the impeller shaft on a side of the impeller opposite the threaded collar; and a fastening arrangement secured to the impeller shaft, the fastening arrangement applying an axial force against the clamping collar in a direction toward the threaded collar so that the threaded collar slides up on the tapered threads of the impeller shaft.

5. The system according to claim 4, wherein the clamping collar has an annular formation extending axially into contact with the impeller at an area of the impeller spaced radially from the central bore of the impeller such that the clamping collar contacts the impeller only along the annular formation.

6. The system according to claim 4, wherein the fastening arrangement comprises a screw threadedly received in an end of the impeller shaft.

7. A system for mounting at least one impeller on an impeller shaft without keys and keyways, comprising:

an impeller shaft having tapered threads;

a threaded collar positioned on the impeller shaft and defining a central bore having threads effective to engage the tapered threads on the impeller shaft;

at least one impeller positioned on the impeller shaft and in contact with the threaded collar; and an arrangement axially forcing the impeller into contact with the threaded collar and axially forcing the threaded collar into torque transmitting contact with the tapered threads of the impeller shaft, wherein the at least one impeller comprises two impellers in contact with one another.

8. A system for mounting at least one impeller on an impeller shaft without keys and keyways, comprising:

an impeller shaft having tapered threads;

a threaded collar positioned on the impeller shaft and defining a central bore having threads effective to engage the tapered threads on the impeller shaft;

at least one impeller positioned on the impeller shaft and in contact with the threaded collar; and an arrangement axially forcing the impeller into contact with the threaded collar and axially forcing the threaded collar into torque transmitting contact with the tapered threads of the impeller shaft, wherein the at least one impeller comprises first and second opposing impellers positioned adjacent to one another, each of the impellers having a central bore, and wherein the first impeller is positioned adjacent the clamping collar and has an annular formation extending axially into contact with the second impeller in an area of the second impeller spaced radially from the central bore of the second impeller such that the first impeller contacts the second impeller only along the annular formation.

9. A system for mounting at least one article on a drive shaft without employing key and keyway means, comprising:

a drive shaft having tapered threads;

a threaded collar positioned on the drive shaft and defining a central bore having threads effective to engage the tapered threads on the drive shaft;

at least one article positioned on the drive shaft and in contact with the threaded collar at least one impeller positioned on the impeller shaft and in contact with the threaded collar, the tapered threads of the drive shaft having a first surface generally facing the article and a second surface generally facing away from the article, said first surface defining a first angle with the longitudinal axis of the drive shaft and defining a second angle with a plane normal to said longitudinal axis, wherein said first angle is less than said second angle; and an arrangement axially forcing the article into contact with the threaded collar and axially forcing the threaded collar into torque transmitting contact with the tapered threads of the drive shaft.

10. The system according to claim 9, wherein the threads of the threaded collar are tapered threads.

11. A system for mounting at least one article on a drive shaft without employing key and keyway means, comprising:

a drive shaft having tapered threads;

a threaded collar positioned on the drive shaft and defining a central bore having threads effective to engage the tapered threads on the drive shaft;

at least one article positioned on the drive shaft and in contact with the threaded collar;

an arrangement axially forcing the article into contact with the threaded collar and axially forcing the threaded collar into torque transmitting contact with the tapered threads of the drive shaft; and a clamping collar which has a central bore and which is positioned concentrically on the drive shaft, and fastening means for holding the clamping collar on the drive shaft, the clamping collar being positioned between the fastening means and the article so that the fastening means applies a generally axial force against the clamping collar.

12. The system according to claim 11, wherein the clamping collar further comprises an annular rim extending axially into contact with the article in an area of the article spaced radially from the central bore of the article so that the clamping collar contacts the article only along the annular rim.

13. The system according to claim 12, wherein the at least one article comprises first and second articles each having a hub provided with a central bore, and an outer region, and wherein the first article is positioned next to the clamping collar and comprises an annular formation extending axially into contact with the second article in an area of the second article spaced radially from the central bore of the second article such that the annular formation of the first article contacts the second article only along the annular formation.

14. The system according to claim 11, wherein the fastening means comprises a screw threadedly received in an end of the drive shaft.

15. A method of mounting at least one impeller on an impeller shaft to transmit torque from the impeller shaft to the impeller without keys and keyways comprising:

providing tapered threads on the impeller shaft;

positioning on the impeller shaft a threaded collar such that threads on the threaded collar engage the tapered threads of the impeller shaft;

placing at least one impeller on the impeller shaft in contact with the threaded collar, the tapered threads of the impeller shaft having a first surface generally facing the impeller and a second surface generally facing away from the impeller, said first surface defining a first angle with the longitudinal axis of the impeller shaft and defining a second angle with a plane normal to said longitudinal axis, wherein said first angle is less than said second angle; and applying an axial force on the impeller in a direction toward the threaded collar to move and tighten the threaded collar on the tapered threads of the impeller shaft and enable torque to be transmitted from the impeller shaft to the threaded collar and the impeller.

16. The method of claim 15, wherein the impeller has a central bore, and the axial force is applied to the impeller only in an area of the impeller spaced radially outward from the central bore to deflect radially toward the impeller shaft a portion of the impeller defining the central bore.

17. A method of mounting at least one impeller on an impeller shaft to transmit torque from the impeller shaft to the impeller without keys and keyways comprising:

providing tapered threads on the impeller shaft;

positioning on the impeller shaft a threaded collar such that threads on the threaded collar engage the tapered threads of the impeller shaft;

placing at least one impeller on the impeller shaft in contact with the threaded collar; and applying an axial force on the impeller in a direction toward the threaded collar to move and tighten the threaded collar on the tapered threads of the impeller shaft and enable torque to be transmitted from the impeller shaft to the threaded collar and the impeller, wherein the impeller has a central bore, and the axial force is applied to the impeller only in an area of the impeller spaced radially outward from the central bore to deflect radially toward the impeller shaft a portion of the impeller defining the central bore, and wherein the step of applying an axial force comprises positioning a clamping collar on the impeller shaft in contact with a side of the impeller opposite a side of the impeller contacting the threaded collar, and applying an axial force to the clamping collar.

18. The method of claim 17, wherein the impeller and the clamping collar each has a central bore, and the axial force is applied to the impeller only in an area of the impeller spaced radially outward from the central bore of the impeller by an annular formation extending axially from the clamping collar and into contact with the impeller.

19. A method of mounting at least one impeller on an impeller shaft to transmit torque from the impeller shaft to the impeller without keys and keyways comprising:

providing tapered threads on the impeller shaft;

positioning on the impeller shaft a threaded collar such that threads on the threaded collar engage the tapered threads of the impeller shaft;

placing at least one impeller on the impeller shaft in contact with the threaded collar; and applying an axial force on the impeller in a direction toward the threaded collar to move and tighten the threaded collar on the tapered threads of the impeller shaft and enable torque to be transmitted from the impeller shaft to the threaded collar and the impeller, wherein the step of placing comprises placing two impellers on the impeller shaft, with the backs of the impellers in contact with one another.

20. The method of claim 19, wherein each of said impellers has a central bore, and the axial force is transmitted from one impeller to the other impeller only in an area of said other impeller spaced radially from the central bore of said other impeller.

21. The method of claim 20, wherein the axial force is applied to said other impeller by an annular formation extending axially from said one impeller and into contact with said other impeller.

22. A method of mounting at least one article on a drive shaft to transmit torque from the drive shaft to the article without keys and keyways comprising:

providing tapered threads on the drive shaft;

positioning on the drive shaft a threaded collar such that threads on the threaded collar engage the tapered threads of the drive shaft;

placing at least one article on the drive shaft in contact with the threaded collar, the tapered threads of the drive shaft having a first surface generally facing the article and a second surface generally facing away from the article, said first surface defining a first angle with the longitudinal axis of the drive shaft and defining a second angle with a plane normal to said longitudinal axis, wherein said first angle is less than said second angle; and applying an axial force on the article in a direction toward the threaded collar to move and tighten the threaded collar on the tapered threads of the drive shaft and enable torque to be transmitted from the drive shaft to the threaded collar and the article.

23. The method of claim 22, wherein the article has a central bore, and the axial force is applied to the article only in an area of the article spaced radially outward from the central bore to deflect radially toward the drive shaft a portion of the article defining the central bore.

24. A method of mounting at least one article on a drive shaft to transmit torque from the drive shaft to the article without keys and keyways comprising:

providing tapered threads on the drive shaft;

positioning on the drive shaft a threaded collar such that threads on the threaded collar engage the tapered threads of the drive shaft;

placing at least one article on the drive shaft in contact with the threaded collar; and applying an axial force on the article in a direction toward the threaded collar to move and tighten the threaded collar on the tapered threads of the drive shaft and enable torque to be transmitted from the drive shaft to the threaded collar and the article, wherein the step of applying an axial force comprises positioning a clamping collar on the drive shaft in contact with a side of the article opposite a side of the article contacting the threaded collar, and applying an axial force to the clamping collar.

25. The method of claim 24, wherein the article and the clamping collar each has a central bore, and the axial force is applied to the article only in an area of the article spaced radially outward from the central bore of the article by an annual formation extending axially from the clamping collar and into contact with the article.

26. A method of mounting at least one article on a drive shaft to transmit torque from the drive shaft to the article without keys and keyways comprising:

providing tapered threads on the drive shaft;

positioning on the drive shaft a threaded collar such that threads on the threaded collar engage the tapered threads of the drive shaft;

placing at least one article on the drive shaft in contact with the threaded collar; and applying an axial force on the article in a direction toward the threaded collar to move and tighten the threaded collar on the tapered threads of the drive shaft and enable torque to be transmitted from the drive shaft to the threaded collar and the article, wherein the step of placing comprises placing two articles on the drive shaft, with the articles in contact with one another.

27. The method of claim 26, wherein each of said articles has a central bore, and the axial force is transmitted from one article to the other article only in an area of said other article spaced radially from the central bore of said other article.

28. The method of claim 27, wherein the axial force is applied to said other article by an annular formation extending axially from said one article and into contact with said other article.

* * * * *